US005344555A

United States Patent [19]

Roof et al.

[11] Patent Number: 5,344,555

[45] Date of Patent: Sep. 6, 1994

[54] TREATMENT OF OILS USING REACTION PRODUCTS OF EPOXIDES AND TERTIARY AMINES

[75] Inventors: Glenn L. Roof, Sugar Land; Lawrence N. Kremer, The Woodlands; Robert V. Market, Friendswood, all of Tex.

[73] Assignee: Baker Hughes Incorporated, Houston, Tex.

[21] Appl. No.: 21,655

[22] Filed: Feb. 22, 1993

Related U.S. Application Data

[63] Continuation-in-part of Ser. No. 780,255, Oct. 21, 1991, abandoned.

[51] Int. Cl.[5] ..... C10G 29/20

[52] U.S. Cl. ..... 208/189; 208/207; 208/208 R; 208/236; 208/237

[58] Field of Search ..... 208/189, 207, 208 R, 208/236, 237, 238

[56] References Cited

U.S. PATENT DOCUMENTS

| | | | |
|---|---|---|---|
| 4,594,147 | 6/1986 | Roof et al. | 208/207 |
| 4,867,865 | 9/1989 | Roof | 208/236 |
| 4,929,340 | 5/1990 | Pollastrini et al. | 208/189 |

FOREIGN PATENT DOCUMENTS 2444075 12/1979 France .

*Primary Examiner*—Helane Myers
*Assistant Examiner*—Walter D. Griffin
*Attorney, Agent, or Firm*—Rosenblatt & Assoc.

[57] ABSTRACT

Sour sulfhydryl group containing oils are treated with an effective amount of a sweetening, hydrogen sulfide vapor reducing quaternary ammonium compound of the formula (a) wherein (i) $R^1$, $R^2$ and $R^3$ are hydrocarbon groups including alkyl, aryl, alkaryl or arylalkyl groups, of up to 24 carbon atoms, and if an alkyl group, may include a cycloalkyl; with the proviso that two of $R^1$, $R^2$ and $R^3$ may be in saturated heterocyclic ring which includes said nitrogen atom and may also include an oxygen atom; and (ii) at least one of $R^1$, $R^2$ and $R^3$ has two or more carbon atoms; and (b) wherein $R^4$, $R^5$, $R^6$ and $R^7$ independently are hydrogen or a hydrocarbon group of up to six carbon atoms, with the proviso that two of $R^4$, $R^5$, $R^6$ and $R^7$ may be in a cycloalkane ring. The compounds used in this treatment are especially suitable for high boiling, heavy residual fuels under low mix conditions.

23 Claims, 2 Drawing Sheets

TREATMENT OF OILS USING REACTION PRODUCTS OF EPOXIDES AND TERTIARY AMINES

The present application is a continuation-in-part of application Ser. No. 07/780,255, filed Oct. 21, 1991, abandoned.

BACKGROUND OF THE INVENTION

This invention relates to the treatment of "sour" petroleum and coal liquefaction oils hydrocarbons containing hydrogen sulfide and other organosulfur compounds such as thiols and thiocarboxylic acids, and more particularly, to improved methods of treating such streams by using epoxylated tertiary amines.

Petroleum and synthetic coal liquefaction crude oils are converted into finished products in a fuel products refinery, where principally the products are motor gasoline, distillate fuels (diesel and heating oils), and bunker (residual) fuel oil. Atmospheric and vacuum distillation towers separate the crude into narrow boiling fractions. The vacuum tower cuts deeply into the crude while avoiding temperatures above about 800° F. which cause thermal cracking. A catalytic cracking unit cracks high boiling vacuum gas oil into a mixture from light gases to very heavy tars and coke. In general, very heavy virgin residuum (average boiling points greater than 1100° F.) is blended into residual fuel oil or thermally cracked into lighter products in a visbreaker or coker.

Overhead or distillate products in the refining process generally contain very little, if any, hydrogen sulfide, but may contain sulfur components found in the crude oil, including mercaptans and organosulfides. However, substantial amounts of hydrogen sulfide, as well as mercaptans and organosulfides, are found in vacuum distillation tower bottoms, which may be blended into gas oils and fuel oils.

As employed in this application, "oil" is meant to include the unrefined and refined hydrocarbonaceous products derived from petroleum or from liquefaction of coal, both of which contain sulfur compounds. Thus, the term "oil" includes, particularly for petroleum based fuels, wellhead condensate as well as crude oil which may be contained in storage facilities at the producing field and transported from those facilities by barges, pipelines, tankers, or trucks to refinery storage tanks, or, alternatively, may be transported directly from the producing facilities through pipelines to the refinery storage tanks. The term "oil" also includes refined products, interim and final, produced in a refinery, including distillates such as gasolines, distillate fuels, oils, and residual fuels.

Hydrogen sulfide which collects in vapor spaces above confined hydrogen sulfide containing oils (for example, in storage tanks or barges) is poisonous, in sufficient quantities, to workers exposed to the hydrogen sulfide. Refined fuels must be brought within sulfide and mercaptan specifications for marketability. In the processing of oils, it is desirable to eliminate or reduce atmospheric emissions of noxious hydrogen sulfide, mercaptan or other sulfhydryl compounds associated with sulfur containing oils, in order to improve environmental air quality at refineries.

The prior art relating to the treatment of sour petroleum oils includes methods in which choline base has been employed to treat sour heavy fuel oils to maintain the hydrogen sulfide content in the atmosphere above or associated with such oils at levels within acceptable limits to avoid health hazards to personnel, as disclosed in U.S. Pat. No. 4,867,865. Choline base also has been used to treat gasoline and other motor fuels to remove organosulfur compounds such as thiols, thiolcarboxylic acids, disulfides and polysulfides, as disclosed in U.S. Pat. No. 4,594,147.

The use of choline base for these purposes has its drawbacks. Choline base has a strong unpleasant odor, and at low mix conditions has limited oil solubility. In the presence of water, choline base tends to seek the water in preference to oil, and does not distribute easily and thoroughly in oil without high mixing conditions. Especially, this is a problem with fuel oils and residual oils. These heavy high boiling fuels do not normally flow well at ambient temperatures, and heating at temperatures above about 140° F. and high mix conditions are necessary to mix choline base into them. High mix conditions do not always exist, or may not be feasible, and a better way to treat crude and refined petroleum hydrocarbons remains a challenge in order to reduce hazards of hydrogen sulfide exposure to workers, to bring fuels within sulfide or mercaptan specifications, and to eliminate or reduce atmospheric emissions of noxious hydrogen sulfide, mercaptan or other sulfhydryl compound odors associated with such fuels for improved environmental air quality.

SUMMARY OF THE INVENTION

In accordance with this invention, a new method is provided for sweetening oils which contain at least hydrogen sulfide ($H_2S$) and may also contain organosulfur compounds having a sulfhydryl (—SH) group, also known as a mercaptan group, such as, thiols (R—SH, where R is hydrocarbon group), thiol carboxylic acids (RCO—SH), and dithio acids (RCS—SH). Such oils are treated with an effective sweetening and hydrogen sulfide vapor reducing amount of a compound of a quaternary ammonium ion of the formula

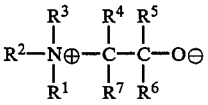

(a) wherein (i) $R^1$, $R^2$ and $R^3$ are hydrocarbon groups including alkyl, aryl, alkaryl or arylalkyl groups, of up to 24 carbon atoms, and if an alkyl group, may include a cycloalkyl; with the proviso that two of $R^1$, $R^2$ and $R^3$ may be in saturated heterocyclic ring which includes said nitrogen atom and may also include an oxygen atom; and (ii) at least one of $R^1$, $R^2$ and $R^3$ has two or more carbon atoms; and (b) wherein $R^4$, $R^5$, $R^6$ and $R^7$ independently are hydrogen or a hydrocarbon group of up to six carbon atoms, with the proviso that two of $R^4$, $R^5$, $R^6$ and $R^7$ may be in a cycloalkane ring. The compounds used in this treatment are suitable for treating all oils but especially are useful for treating high boiling, heavy residual fuels under low mix conditions. These fuels may be treated at temperatures up to a maximum temperature at which the compounds themselves crack or decompose. Preferred treatment temperatures are from about 100° F. to about 400° F.

Such compounds may also be used to reduce hydrogen sulfide vapor in vapor spaces above confined oils to acceptable limits by treating such oils with an effective hydrogen sulfide reducing amount of such compound. Such treatment is effective where the hydrogen sulfide level above the liquid petroleum hydrocarbon to be treated is between 10 ppm to 100,000 ppm(v).

Such compounds may also be used to reduce noxious atmospheric odors of hydrogen sulfide, mercaptans and other sulfhydryl compounds from oils by treating such products with an effective odor reducing amount of such compounds.

DETAILED DESCRIPTION OF THE INVENTION

Figure 1:
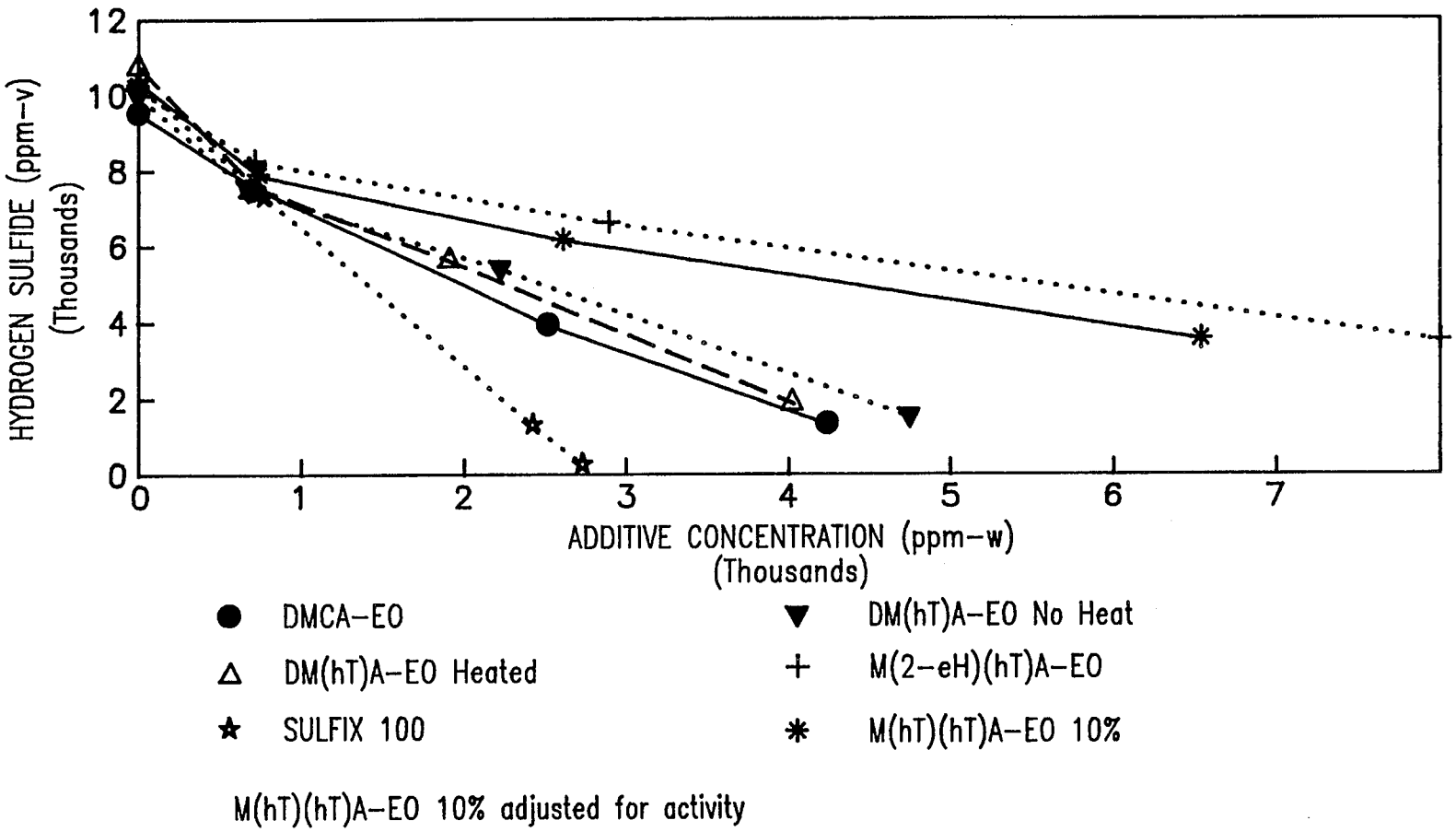
FIG. 1 is a chart showing hydrogen sulfide abatement as a function of additive concentration (ppm-w).
Figure 2:
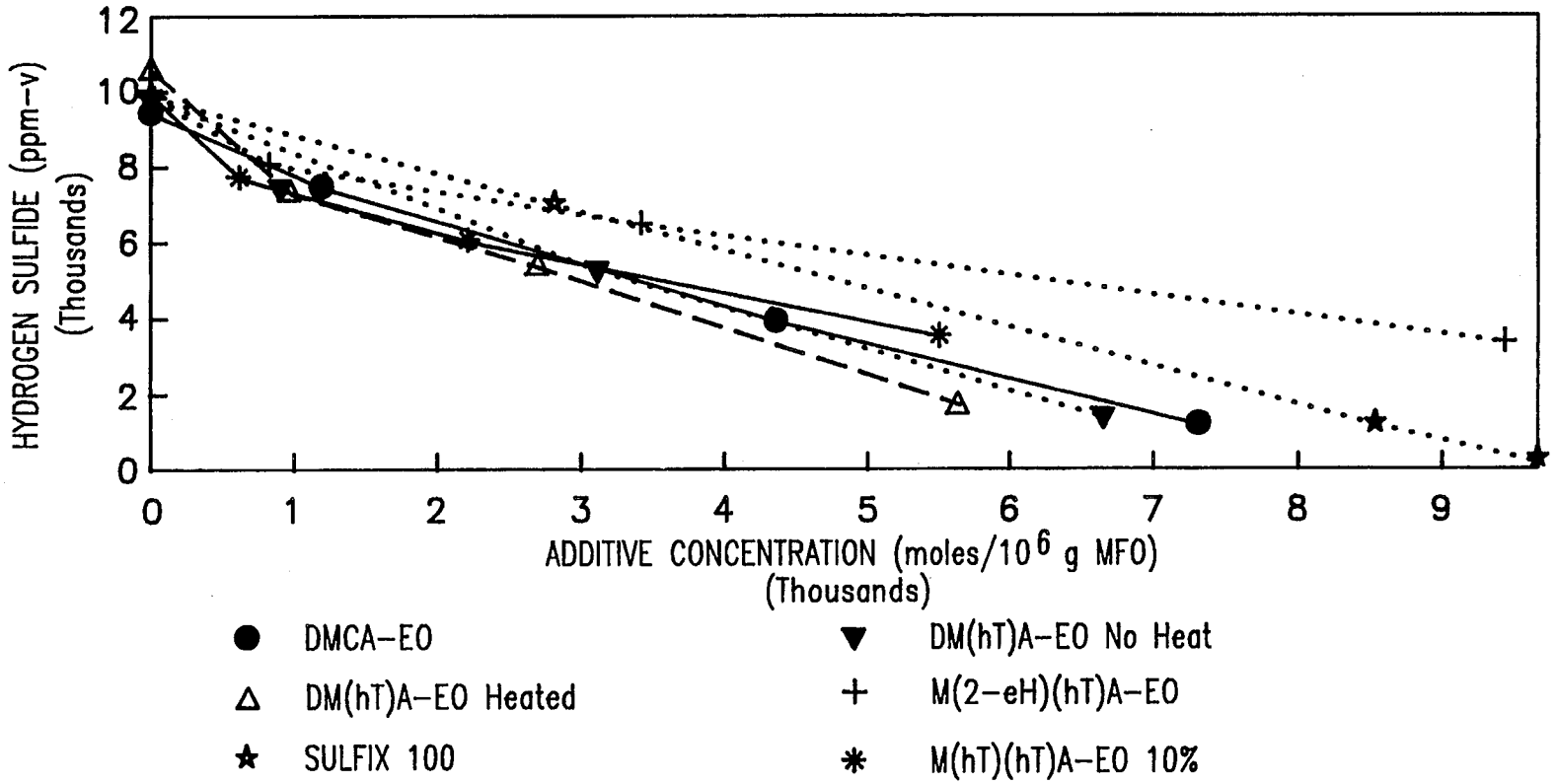
FIG. 2 is a chart showing hydrogen sulfide abatement as a function of molar additive concentration.

The compound of a quaternary ammonium ion of the above and foregoing formula is suitably prepared by epoxylating a tertiary amine with an epoxide, suitably in a polar hydrocarbon solvent medium according to the reaction:

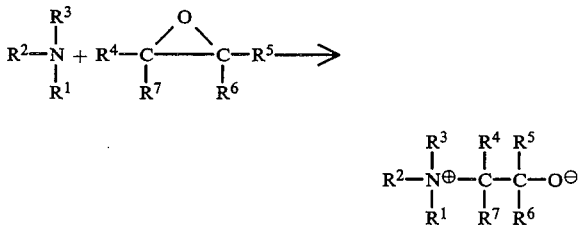

in which $R^1$, $R^2$, $R^3$, $R^4$, $R^5$, $R^6$, and $R^7$ have the same meanings as set forth above. Preferably, the reaction is conducted so that the quantity of tertiary amine is approximately equal to the epoxide on a molar basis, in order that a one-to-one adduct is the predominant product.

The quaternary ammonium ion compound is suitably formed by epoxylating a tertiary amine of the general formula

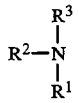

Suitable tertiary amines in which the substituent groups $R^1$, $R^2$ and $R^3$ are all alkyls include triethylamine, dimethylethylamine, tripropylamine, dimethylpropylamine, methylethylpropylamine, diethylpropylamine, ethyldipropylamine, tributylamine, dimethylbutylamine, methylethylbutylamine, methylpropylbutylamine, diethylbutylamine, triamylamine, trihexylamine, triheptylamine, trioctylamine, dimethylcocoamine, dimethyllaurylamine, dimethylpalmylamine, and dimethylsterylamine; and wherein the alkyl groups are cycloalkyls, include tricyclopentylamine and tricyclohexylamine; and wherein two of $R^1$, $R^2$ and $R^3$ may be in a saturated heterocyclic ring which includes the nitrogen atom of the tertiary amine, include N-methyl pyrrolidine and N-methylpiperidine; and wherein the saturated heterocyclic ring may also include an oxygen atom, includes N-methyl morpholine; and wherein the $R^1$, $R^2$ and $R^3$ may include an aryl group, include triphenylamine, diphenylmethylamine, diphenylethylamine, diphenylpropylamine, dimethylphenylamine, diethylphenylamine, dipropylphenylamine; and wherein $R^1$, $R^2$ and $R^3$ may include an arylalkyl group, include tribenzylamine, dimethylbenzylamine, methylethylbenzylamine and the like.

The tertiary amine in a polar solvent such as lower alkyl alcohol, suitably a $C_1$–$C_4$ alcohol, preferably methanol, is reacted with approximately one mole of an epoxide, to produce at least a one-to-one adduct of the quaternary ammonium ion product. The epoxide employed has a formula

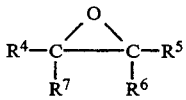

in which $R^4$, $R^5$, $R^6$ and $R^7$ have the same meanings as set forth above. Examples of suitable epoxides include ethylene oxide ($R^4$, $R^5$, $R^6$, $R^7$ each are hydrogen); propylene oxide (one of $R^4$, $R^5$, $R^6$, $R^7$ is methyl, the others are hydrogen); 1, 2-epoxybutane (one of $R^4$, $R^5$, $R^6$, $R^7$ is ethyl, the others are hydrogen); 2,3-epoxybutane (one of $R^4$ and $R^7$ and one of $R^5$ and $R^6$ is methyl, the others are hydrogen); 1,2 cyclohexene oxide ($R^6$ and $R^7$ total four carbons and are in a cyclohexane ring which includes the alkylene carbons; $R^4$ and $R^5$ are hydrogen); and styrene oxide (one of $R^4$, $R^5$, $R^6$ and $R^7$ is a phenyl group).

Ethylene oxide and propylene oxide are preferred epoxylating compounds. Methanol is the preferred solvent. The reaction is conducted to provide a finished methanol solution of the quaternary ammonium ion compound having a concentration of that product ranging from 5 to about 100 percent by weight. The reaction mixture may contain from 0.1 to about 30 percent by weight of unreacted tertiary amine and up to about 10 percent by weight of various polyalkyleneoxides. For purposes of the invention, this crude reaction product of predominately the quaternary ammonium ion compound employed in this invention is suitably used.

Preferred quaternary ammonium ion compounds are those in which $R^1$, $R^2$ and $R^3$ are alkyl groups and in which at least three of $R^4$, $R^5$, $R^6$ and $R^7$ are hydrogen. A preferred group of such compounds is one in which the alkyl groups have less than 12 carbon atoms, for example as obtained by treating tributylamine or trioctylamine with the epoxide. Another preferred group is one in which two of $R^1$, $R^2$ and $R^3$ have less than 12 carbon atoms and one of $R^1$, $R^2$ and $R^3$ has from 12 to 24 carbon atoms, as obtained, for example by reacting dimethylcocoamine with the epoxide. In these preferred instances, the epoxides are ethylene oxide (where all of $R^4$, $R^5$, $R^6$ and $R^7$ are hydrogen) and propylene oxide (where three of $R^4$, $R^5$, $R^6$ and $R^7$ are hydrogen and one is a methyl group).

The quaternary ammonium ion products of this invention are more oil soluble than choline base and accordingly are more thoroughly dispersed and more effectively decrease the concentration of hydrogen sulfide and other organosulfur compounds having a sulfhydryl group where low mix conditions occur. The products of this invention also generally are not so strongly malodorous as choline base and are more favored for handling.

To sweeten an oil, the molar amount of quaternary ammonium compounds of this invention added to a sour oil is directly proportional to the molar amounts of hydrogen sulfide, mercaptans or other organosulfur compound(s) having a sulfhydryl group which are present in the oil. The quaternary ammonium compound suitably is mixed in the oil at temperatures at which the oil is flowable for ease of mixing until reaction with hydrogen sulfide or with sulfhydryl-containing organosulfur compounds has produced a product with sulfhydryls removed to an acceptable or specification grade oil product. To reduce hydrogen sulfide in the vapor space above confined oils to within acceptable limits, preferably an amount of the quaternary ammonion ion compound of this invention directly proportional to the amount of hydrogen sulfide present in the vapor space is employed to treat the oil.

To reduce noxious atmospheric odors of hydrogen sulfide, mercaptans and other organosulfhydryl compounds from oils, effective odor reducing amounts of the subject quaternary ammonium compound are used to treat the oil. Such amounts are in direct proportion to the concentration of sulfhydryl groups.

Without being bound to a particular explanation for the mechanism by which the quaternary ammonium ions of this invention react with the sulfhydryl groups, it is believed that the reaction generally may be described as follows:

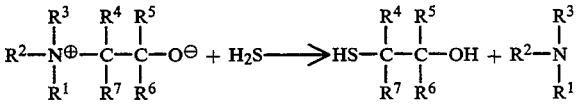

and

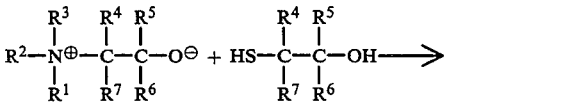

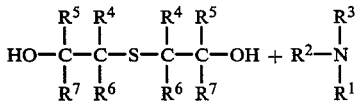

and/or

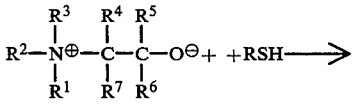

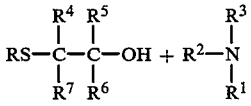

and/or

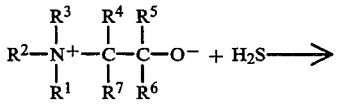

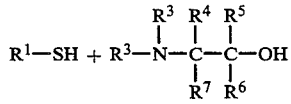

The reaction proceeds more quickly at elevated temperatures and the oil may have a temperature of up to about 400° F. without significant loss of activity of the quaternary ammonium ion treating agent. Hydrogen sulfide contents of up to about 100,000 ppm in oil may be treated satisfactorily in accordance with this method.

The following examples illustrate the preparation of four quaternary ammonium ion agents prepared in accordance with this invention and employed to treat crude stocks spiked with hydrogen sulfide.

EXAMPLE 1

Tributyl amine (185 gms) in methanol (225.46 gms) is placed in a stainless reactor fitted with cooling coils, a stirring mixer, and an ethylene oxide sparging tube. The reactor is closed with a lid and placed in a heat jacket, and the cooling coil regulator is set at 35° C. The reactor is first sparged with nitrogen and then sparged with ethylene oxide for one and one-half hours with the temperature of the reaction condition not exceeding 35° C. 445 grams of reaction mixture is obtained. The reaction mixture is clear water white with no haze.

A 300 μL aliquot of the reaction product is added to 86 grams of a residual fuel produced from Arab crude stocks which is predosed with 2,948 ppm of hydrogen sulfide. The sample is shaken 80 times to assure thorough mixing and is aged in a 140° F. bath overnight. The aged samples are removed from the water bath, shaken three minutes on a high speed shaker, and read with Drager tubes. The sample shows no indication of hydrogen sulfide, i.e., less than five parts per million of hydrogen sulfide.

EXAMPLES 2–4

The same procedure as followed for Example 1 is employed, except that in Example 2, 240.01 grams of dimethylcoco amine in 283.50 grams of methanol is instead reacted, an excess of ethylene oxide is employed, and a yield of 598.6 grams is achieved. The product is a hazy white mobile liquid.

In Example 3, 240 grams of dimethylcoco amine in 284.1 grams of methanol is reacted with ethylene oxide as described for Example 1, yielding a product mixture weighing 568.7 grams which has a clear water white, slightly yellow, appearance.

In Example 4, 222.7 grams of triethylamine in 330 grams of methanol is reacted with ethylene oxide as in Example 1 to yield 641 grams of reaction product which has a water white appearance.

Aliquots from the reaction products produced in Examples 2, 3, and 4, respectively, aliquot samples 2, 3 and 4, are reacted with residual fuels from Arab crude stocks predosed with hydrogen sulfide and are aged and tested for hydrogen sulfide content as described for Example 1. Comparative tests were conducted in the same fashion for a choline base treating agent of the type described in U.S. Pat. No. 4,867,865 sold by Chem-Link Co under the trademark "SULFIX TM 100 additive." Untreated samples were also aged and tested. The results are set forth in the following table:

| Sample | Treatment Level ppm | Sample | Post-Treatment ppm $H_2S$(v) |
|---|---|---|---|
| W | 2,461 | Sample 2 | 0 |
| S | 2,914 | Sample 3 | 0 |
| T | 2,817 | Sample 4 | 0 |
| Sulfix 100 | 2,848 | Sulfix 100 | 0 |
| U | 0 | | 50 |

-continued

| Sample | Treatment Level ppm | Sample | Post-Treatment ppm $H_2S$(v) |
|---|---|---|---|
| X | 0 | | 100 |

The foregoing illustrate that quaternary ammonium ion compound treatment is effective to eliminate hydrogen sulfide from the oil.

EXAMPLE 5

Residual fuel oil was introduced into a sealed heated mixing chamber, namely a Welker Shell HET Tester obtained from Welker Engineering, Sugar Land, Tex. To remove the oxygen atmosphere in the mixing chamber, the fuel in the chamber was blanketed with nitrogen. The nitrogen then was mixed with the fuel to displace any oxygen present in the fuel. This procedure was repeated 2–3 times to ensure complete removal of oxygen from both the fuel and the vapor space.

After the foregoing procedure, the mixing chamber headspace was purged with concentrated hydrogen sulfide gas. The mixing chamber, which was equipped with a perforated movable piston for mixing, was agitated to incorporate the hydrogen sulfide in the residual oil.

Next, an empty 100 mL serum bottle was purged with nitrogen (to remove any oxygen) and the hydrogen sulfide rich fuel was transferred to a premarked volume in the serum bottle. After the fuel was transferred, the samples were blanketed with nitrogen, sealed with teflon lined rubber septa, and the sample bottles were shaken and placed in an oven to equilibrate. After a set time (to allow equilibration of hydrogen sulfide between liquid and vapor), a sample of the headspace gas was withdrawn by way of a gas tight microliter syringe and the gas sample was injected into a presealed 10 mL serum bottle containing a single glass bead. This dilution step was introduced (1) to ensure a clean (i.e., an oil free) sample for gas chromatographic analysis, and (2) to broaden the possible sulfur detection range. The typical volume that was withdrawn from the oil bottle samples ranged from 100 to 1000 microliters of headspace gas.

While withdrawing a gas ample for analysis from the 10 mL serum bottle using a 1 to 10 microliter gas tight syringe, the needle tip was pulled through the septum, and the plunger was pulled back during transfer of the sample to the gas chromatograph to ensure that no sample was lost from the syringe. At these small gas volumes any sample loss would introduce a large error. Typical gas volumes for injection ranged from 1 to 3 microliters for the initial analysis and could be as large as 200 microliters towards the end of the analysis, where the hydrogen sulfide levels were very low.

Having now described our invention, variations, modifications and changes within the scope of our invention will be apparent to those of ordinary skill in the art, as set forth in the following claims.

What is claimed is:

1. A method of sweetening sour oils, which comprises reacting hydrogen sulfide contained in said oils with an effective sweetening amount of a dipolar compound to produce organosulfur compounds, said dipolar compound comprising a quaternary ammonium ion of the formula

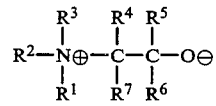

(a) wherein (i) $R^1$, $R^2$ and $R^3$ are hydrocarbon groups including alkyl, aryl, alkaryl or arylalkyl groups, of up to 24 carbon atoms, and if an alkyl group, may include a cycloalkyl; with the proviso that two of $R^1$, $R^2$ and $R^3$ may be in saturated heterocyclic ring which includes said nitrogen atom and may also include an oxygen atom; and (ii) at least one of $R^1$, $R^2$ and $R^3$ has two or more carbon atoms; and (b) wherein $R^4$, $R^5$, $R^6$ and $R^7$ independently are hydrogen or a hydrocarbon group of up to six carbon atoms, with the proviso that two of $R^4$, $R^5$, $R^6$ and $R^7$ may be in a cycloalkane ring.

2. The method of claim 1 in which the oil is a residual fuel.

3. The method of claim 1 in which the oil is treated at temperature from about 100° F. to about 400° F.

4. The method of claim 1 in which the amount of said compound is directly proportional to the sulfhydryl content of said oil.

5. A method of reducing hydrogen sulfide vapor in a vapor space above confined oil, which comprises reacting hydrogen sulfide contained in said oil and said vapor with an effective hydrogen sulfide reducing amount of a dipolar compound to produce organosulfur compounds, said dipolar compound comprising a quaternary ammonium ion of the formula

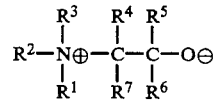

(a) wherein (i) $R^1$, $R^2$ and $R^3$ are hydrocarbon groups including alkyl, aryl, alkaryl or arylalkyl groups, of up to 24 carbon atoms, and if an alkyl group, may include a cycloalkyl; with the proviso that two of $R^1$, $R^2$ and $R^3$ may be in saturated heterocyclic ring which includes said nitrogen atom and may also include an oxygen atom; and (ii) at least one of $R^1$, $R^2$ and $R^3$ has two or more carbon atoms; and (b) wherein $R^4$, $R^5$, $R^6$ and $R^7$ independently are hydrogen or a hydrocarbon group of up to six carbon atoms, with the proviso that two of $R^4$, $R^5$, $R^6$ and $R^7$ may be in a cycloalkane ring.

6. The method of claim 5 in which the amount of said compound is directly proportional to the amount of hydrogen sulfide present in said vapor space.

7. The method of claim 6 in which the amount of hydrogen sulfide present in said vapor space is from 10 to 100,000 ppm(v).

8. A method of reducing noxious odors of hydrogen sulfide, mercaptans and other sulfhydryl compounds in the atmosphere from oil which comprises reacting hydrogen sulfide contained in said atmosphere and said oil with an effective odor reducing amount of a dipolar compound to produce organosulfur compounds, said dipolar compound comprising a quaternary ammonium ion of the formula

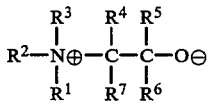

(a) wherein (i) $R^1$, $R^2$and $R^3$ are hydrocarbon groups including alkyl, aryl, alkaryl or arylalkyl groups, of up to 24 carbon atoms, and if an alkyl group, may include a cycloalkyl; with the proviso that two of $R^1$, $R^2$ and $R^3$ may be in saturated heterocyclic ring which includes said nitrogen atom and may also include an oxygen atom; and (ii) at least one of $R^1$, $R^2$ and $R^3$ has two or more carbon atoms; and (b) wherein $R^4$, $R^5$, $R^6$ and $R^7$ independently are hydrogen or a hydrocarbon group of up to six carbon atoms, with the proviso that two of $R^4$, $R^5$, $R^6$ and $R^7$ may be in a cycloalkane ring.

9. The method of claim 8 in which $R^1$, $R^2$ and $R^3$ are alkyl groups and at least three of $R^4$, $R^5$, $R^6$ and $R^7$ are hydrogen.

10. The method of claim 9 in which one of $R^4$, $R^5$, $R^6$ and $R^7$ is a methyl group.

11. The method of claim 9 in which $R^1$, $R^2$ and $R^3$ are alkyl groups that have less than 12 carbon atoms.

12. The method of claim 9 in which two of $R^1$, $R^2$ and $R^3$ are alkyls that have less than 12 carbon atoms and one of $R^1$, $R^2$ and $R^3$ is an alkyl having from 12 to 24 carbon atoms.

13. The method of claim 1 in which $R^1$, $R^2$ and $R^3$ are alkyl groups and at least three of $R^4$, $R^5$, $R^6$ and $R^7$ are hydrogen.

14. The method of claim 13 in which one of $R^4$, $R^5$, $R^6$ and $R^7$ is a methyl group.

15. The method of claim 13 in which $R^1$, $R^2$ and $R^3$ are alkyl groups that have less than 12 carbon atoms.

16. The method of claim 13 in which two of $R^1$, $R^2$ and $R^3$ are alkyls that have less than 12 carbon atoms and one of $R^1$, $R^2$ and $R^3$ is an alkyl having from 12 to 24 carbon atoms.

17. The method of claim 5 in which $R^1$, $R^2$ and $R^3$ are alkyl groups and at least three of $R^4$, $R^5$, $R^6$ and $R^7$ are hydrogen.

18. The method of claim 17 in which one of $R^4$, $R^5$, $R^6$ and $R^7$ is a methyl group.

19. The method of claim 17 in which $R^1$, $R^2$ and $R^3$ are alkyl groups that have less than 12 carbon atoms.

20. The method of claim 17 in which two of $R^1$, $R^2$ and $R^3$ are alkyls that have less than 12 carbon atoms and one of $R^1$, $R^2$ and $R^3$ is an alkyl having from 12 to 24 carbon atoms.

21. The method of claim 1 wherein said method is performed substantially in the absence of oxygen.

22. The method of claim 5 wherein said method is performed substantially in the absence of oxygen.

23. The method of claim 8 wherein said method is performed substantially in the absence of oxygen.

* * * * *